US010548791B2

(12) United States Patent
Michaelis et al.

(10) Patent No.: US 10,548,791 B2
(45) Date of Patent: Feb. 4, 2020

(54) ARM SUPPORT FOR SUPINE PATIENT

(71) Applicants: Tim Michaelis, Salt Lake City, UT (US); Talmage Barth, Salt Lake City, UT (US); Michael Price, Salt Lake City, UT (US); Ryan O'Hara, Salt Lake City, UT (US); Holden Brown, Salt Lake City, UT (US); Nicole Nielsen Davis, Salt Lake City, UT (US)

(72) Inventors: Tim Michaelis, Salt Lake City, UT (US); Talmage Barth, Salt Lake City, UT (US); Michael Price, Salt Lake City, UT (US); Ryan O'Hara, Salt Lake City, UT (US); Holden Brown, Salt Lake City, UT (US); Nicole Nielsen Davis, Salt Lake City, UT (US)

( * ) Notice: Subject to any disclaimer, the term of this patent is extended or adjusted under 35 U.S.C. 154(b) by 568 days.

(21) Appl. No.: 15/093,254

(22) Filed: Apr. 7, 2016

(65) Prior Publication Data

US 2016/0296397 A1 Oct. 13, 2016

Related U.S. Application Data

(60) Provisional application No. 62/144,733, filed on Apr. 8, 2015.

(51) Int. Cl.
*A61G 7/075* (2006.01)
*A61G 13/12* (2006.01)

(52) U.S. Cl.
CPC ..... *A61G 7/075* (2013.01); *A61G 13/1205* (2013.01); *A61G 13/126* (2013.01); *A61G 13/1235* (2013.01); *A61G 2200/327* (2013.01); *A61G 2210/50* (2013.01)

(58) Field of Classification Search
CPC ..... A61G 7/065; A61G 7/075; A61G 13/10; A61G 13/12; A61G 13/1205; A61G 13/122; A61G 13/1235; A61G 13/124; A61G 13/126; A61G 13/1285; A61G 2210/50; A61G 2200/327
See application file for complete search history.

(56) References Cited

U.S. PATENT DOCUMENTS 2,459,033 A * 1/1949 Kraus ..... A61G 13/12 248/118
2,766,463 A * 10/1956 Bendersky ..... A61G 7/075 248/118
3,020,909 A * 2/1962 Stevens ..... A61G 13/0036 5/623
3,946,451 A * 3/1976 Spann ..... A61G 7/0755 5/650

(Continued)

OTHER PUBLICATIONS

"CT EZ-Positioner" by TechnoAide, available at <https://techno-aide.com/store/product/ct_ez_positioner#.Wd-3yGeWxmK>.

*Primary Examiner* — David R Hare
(74) *Attorney, Agent, or Firm* — Durham Jones & Pinegar; Sarah W. Matthews

(57) ABSTRACT

An arm support for a supine patient includes a support which can easily be attached to or removed from a standard medical table pad, and which supports the patient's forearms at an angle parallel to the body, with the biceps at right angles to the body. The arm support may include arm rests which may be slideably moved to accommodate patients with narrower or broader shoulder widths.

19 Claims, 9 Drawing Sheets

(56) References Cited

U.S. PATENT DOCUMENTS

| | | | | | |
|---|---|---|---|---|---|
| 4,270,235 | A * | 6/1981 | Gutmann | A61G 7/075 | 5/646 |
| 5,214,814 | A * | 6/1993 | Eremita | A47G 9/109 | 5/632 |
| 5,353,809 | A * | 10/1994 | Faucher | A61B 6/0421 | 128/878 |
| 5,410,769 | A * | 5/1995 | Waterman | A61B 6/0421 | 5/632 |
| 5,537,702 | A | 7/1996 | Brown-Milants et al. | | |
| 5,771,512 | A | 6/1998 | Kurakake et al. | | |
| 5,785,057 | A * | 7/1998 | Fischer | A61F 5/3761 | 128/846 |
| 6,691,353 | B2 * | 2/2004 | Fuhriman | A47C 20/023 | 5/632 |
| 6,948,502 | B2 * | 9/2005 | Berger | A61B 6/0421 | 128/845 |
| 7,263,733 | B2 * | 9/2007 | Fujita | A61B 6/0421 | 5/601 |
| 7,555,794 | B2 | 7/2009 | Zelnik et al. | | |
| 7,603,730 | B2 * | 10/2009 | Zelnik | A47C 20/00 | 378/208 |
| 8,261,385 | B2 * | 9/2012 | Mazzei | A61G 13/121 | 5/622 |
| 8,590,848 | B1 * | 11/2013 | Newlen | A61G 7/075 | 128/845 |
| 8,594,273 | B2 * | 11/2013 | Ishii | A61B 6/04 | 378/20 |
| 8,745,790 | B1 * | 6/2014 | Wyrozub | A61G 13/1235 | 5/621 |
| 2011/0035882 | A1 * | 2/2011 | Lijun | A61B 6/0421 | 5/601 |
| 2014/0059772 | A1 * | 3/2014 | Crisco | A61G 13/1235 | 5/623 |

* cited by examiner

ARM SUPPORT FOR SUPINE PATIENT

BACKGROUND

State of the Art

The present invention relates to a method and apparatus of supporting a patient's arms in a position suitable for medical imaging when the patient is supine, or lying flat on his or her back. More specifically, the present invention provides a support which can easily be attached to a standard medical table pad, and which supports the patient's forearms.

Field of Art

During some medical imaging procedures, such as computerized axial tomography (CAT), magnetic resonance imaging (MRI), or certain X-ray procedures, patients lay flat on a padded table. A patient may be instructed to keep his arms flat at his sides during the procedure in an 'arms-down' position; however, there are multiple drawbacks to this position. Keeping the patient's arms at his sides increases the radiation dose absorbed during certain scans by as much as twenty percent. Arms in the arms-down position can cause scanning artifacts, which can conceal dangerous hemorrhages. Additionally, the overall image quality—especially of organs in the abdominal area—may be significantly degraded by an arms-down position.

In order to address this problem, patients may be asked to keep their arms stretched flat above their heads during torso scans. Because a CAT scan or MRI can take between 10 minutes and two hours, this position must sometimes be held for a long period, without moving. Many patients have difficulty holding this 'arms-up' position for a long period of time, particularly injured and/or elderly patients. Individuals with rotator-cuff injuries to the shoulder may be physically unable to move their arms upward sufficiently.

Further, when arms are overhead for a length of time, patients may naturally allow their elbows to move outward, away from the center of the mat, pad, or table. This movement may physically interfere with the scanning equipment or medical personnel, and additionally rotates the patient's shoulder out and back. This external-rotation movement may not only degrade the image quality of the scan, but also results in strain to the shoulder joint.

Patients prone to shoulder injury, particularly the elderly or those already injured, are often unable to hold the correct position for an extended length of time. Such patients may be asked to fold their arms over their upper abdomens instead. However, this position still interferes with image quality, and generally does not reduce radiation dose when the whole torso is being scanned.

Heretofore, several types of arm support devices have been used. In general, these devices are bulky, difficult to attach to the medical imaging table, and may interfere with access to the patient's head when, for example, breathing tubes or IV lines must be supplied. Moreover, these devices do not prevent external rotation of the shoulder cuff, and thus, a patient's elbows may slip outward during the course of the scan and cause strain to the patient's shoulders. Finally, arm supports suitable for use with medical scanners are not well-adapted for patients having varying shoulder widths. Medical scanning arm support devices are often large, expensive to construct, difficult to clean, and do not adequately solve the problem of external shoulder rotation.

SUMMARY OF THE INVENTION

The following summary of the present invention is not intended to describe each illustrated embodiment or every possible implementation of the invention, but rather to give illustrative examples of application of principles of the invention. No aspect of the invention discussed herein need be included in the invention unless specifically set forth in a particular claim.

In some embodiments, the arm support assembly may include a stability plate, and a slideable arm rest releaseably attached to the stability plate. The slideable arm rest may have an ergonomic groove shaped to fit a patient's forearm.

In accordance with one aspect of the present disclosure, the slideable arm rest may further include a pad spacer adapted to fit a medical pad.

In accordance with one aspect of the disclosure, the slideable arm rest may further include a shoulder stop which extends substantially at a right angle to the stability plate.

In accordance with another aspect of the disclosure, the slideable arm rest may also include an arm rest inner curve and an arm rest outer curve.

In some embodiments, the slideable arm rest may also have a gripping surface or gripping strap.

In accordance with one aspect of the disclosure, the slideable arm rest may provide for openings, such as ear-access openings, to facilitate access to a patient's head.

In accordance with still another aspect of the disclosure, the slideable arm rest may include arm rest spacing slot and an arm rest screw opening. The arm rest screw opening may be threaded, may have textured cut sides, or may be smooth-cut.

In accordance with still another aspect of the disclosure, the stability plate may be equipped with a spacing indicator and an anchor slot.

In accordance with still another aspect of the disclosure, the slideable arm rest may have a second arm rest screw opening, and the stability plate may have a second anchor slot.

In accordance with still another aspect of the disclosure, the slideable arm rest may include a second arm rest spacing slot, and the stability plate may include a second spacing indicator.

In accordance with another aspect of the disclosure, wherein the slideable arm rest may also include a screw access cutout.

In accordance with still another aspect of the disclosure, the slideable arm rest may also have an arm rest base. The pad spacer may be connected to the arm rest base at an angle of somewhat less than ninety degrees, so that the arm rest base may slope down towards the stability plate.

In some embodiments, both or either of the slideable arm rest and the stability plate may be made of plastic.

In accordance with another aspect of the disclosure, two slideable arm rests may be provided.

In some embodiments, the arm rest may be made of portions for ease of manufacturing, storage, and replacement of worn parts. The portions may snap together with notches and protrustions.

In accordance with an aspect of the disclosure, a cutout may be provided in order to better enable a user to reach the arm rest screw opening or openings.

These and other aspects of the present invention are realized in an arm support for a supine patient shown and described in the following figures and related description. It will be appreciated that various embodiments of the invention may not include each aspect set forth above and aspects discussed above shall not be read into the claims unless specifically described therein.

BRIEF DESCRIPTION OF THE DRAWINGS

Various embodiments of the present disclosure are shown and described in reference to the numbered drawings.

Figure 1:
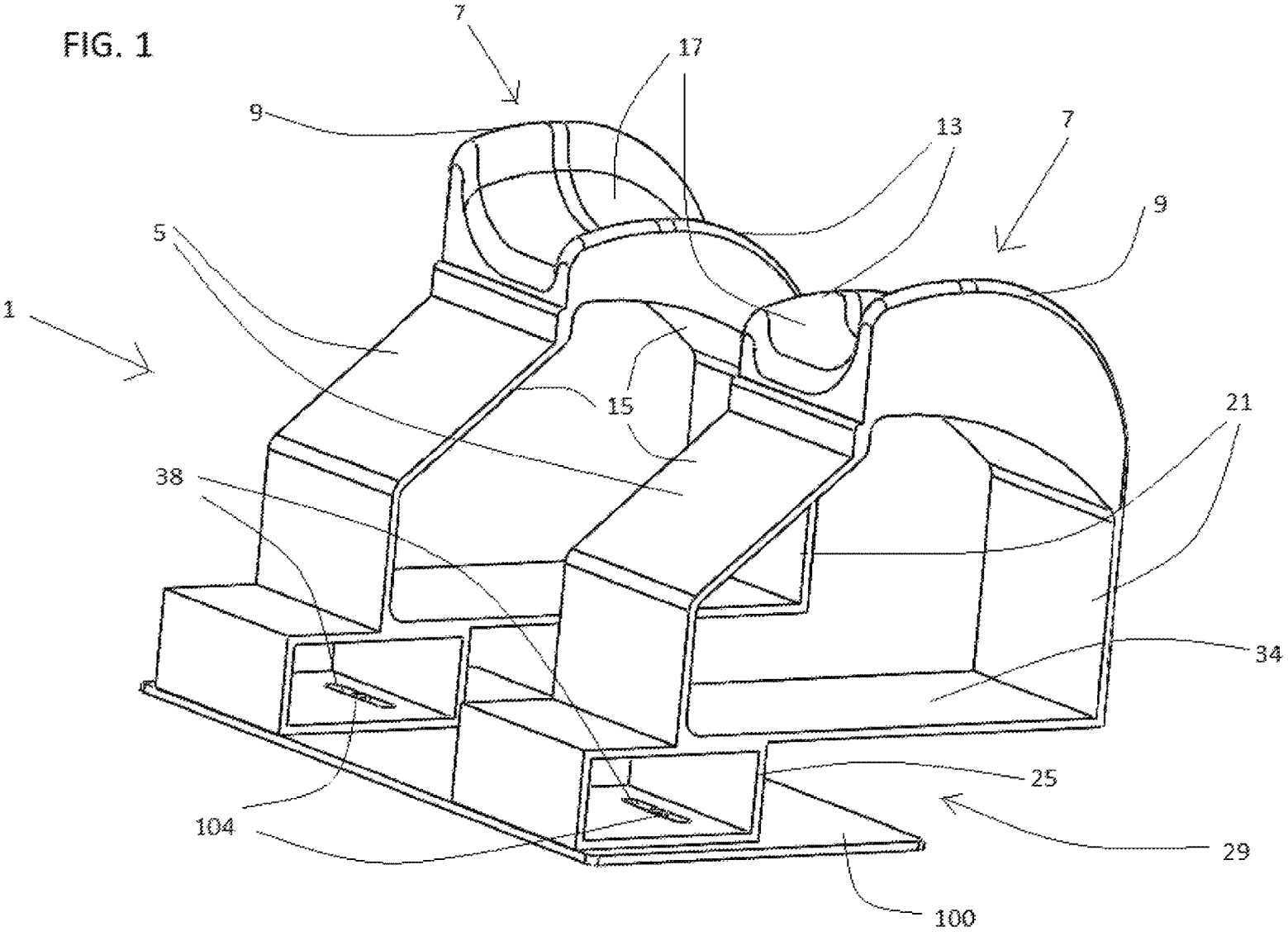
FIG. 1 illustrates a perspective view of a fully-assembled arm support for a supine patient.

It will be appreciated that the drawings are illustrative and not limiting of the scope of the invention which is defined by the appended claims. The embodiments shown accomplish various aspects and objects of the invention. It will be appreciated that it is not possible to clearly show each element and aspect of the present disclosure in a single figure, and as such, multiple figures are presented to separately illustrate the various details of different aspects of the invention in greater clarity. Similarly, not all configurations or embodiments described herein or covered by the appended claims will include all of the aspects of the present disclosure as discussed above.

DETAILED DESCRIPTION

Various aspects of the invention and accompanying drawings will now be discussed in reference to the numerals provided therein so as to enable one skilled in the art to practice the present invention. The skilled artisan will understand, however, that the methods described below can be practiced without employing these specific details, or that they can be used for purposes other than those described herein. Indeed, they can be modified and can be used in conjunction with products and techniques known to those of skill in the art in light of the present disclosure. The drawings and the descriptions thereof are intended to be exemplary of various aspects of the invention and are not intended to narrow the scope of the appended claims. Furthermore, it will be appreciated that the drawings may show aspects of the invention in isolation and the elements in one figure may be used in conjunction with elements shown in other figures.

Reference in the specification to "one embodiment," "one configuration," "an embodiment," or "a configuration" means that a particular feature, structure, or characteristic described in connection with the embodiment may be included in at least one embodiment, etc. The appearances of the phrase "in one embodiment" in various places may not necessarily limit the inclusion of a particular element of the invention to a single embodiment, rather the element may be included in other or all embodiments discussed herein.

Furthermore, the described features, structures, or characteristics of embodiments of the present disclosure may be combined in any suitable manner in one or more embodiments. In the following description, numerous specific details may be provided, such as examples of products or manufacturing techniques that may be used, to provide a thorough understanding of embodiments of the invention. One skilled in the relevant art will recognize, however, that embodiments discussed in the disclosure may be practiced without one or more of the specific details, or with other methods, components, materials, and so forth. In other instances, well-known structures, materials, or operations may not be shown or described in detail to avoid obscuring aspects of the invention.

Before the present invention is disclosed and described in detail, it should be understood that the present invention is not limited to any particular structures, process steps, or materials discussed or disclosed herein, but is extended to include equivalents thereof as would be recognized by those of ordinarily skill in the relevant art. More specifically, the invention is defined by the terms set forth in the claims. It should also be understood that terminology contained herein is used for the purpose of describing particular aspects of the invention only and is not intended to limit the invention to the aspects or embodiments shown unless expressly indicated as such. Likewise, the discussion of any particular aspect of the invention is not to be understood as a requirement that such aspect is required to be present apart from an express inclusion of that aspect in the claims.

It should also be noted that, as used in this specification and the appended claims, singular forms such as "a," "an," and "the" may include the plural unless the context clearly dictates otherwise. Thus, for example, reference to "a bracket" may include an embodiment having one or more of such brackets, and reference to "the target plate" may include reference to one or more of such target plates.

As used herein, the term "substantially" refers to the complete or nearly complete extent or degree of an action, characteristic, property, state, structure, item, or result to function as indicated. For example, an object that is "substantially" enclosed would mean that the object is either completely enclosed or nearly completely enclosed. The exact allowable degree of deviation from absolute completeness may in some cases depend on the specific context, such that enclosing the nearly all of the length of a lumen would be substantially enclosed, even if the distal end of the structure enclosing the lumen had a slit or channel formed along a portion thereof. The use of "substantially" is equally applicable when used in a negative connotation to refer to the complete or near complete lack of an action, characteristic, property, state, structure, item, or result. For example, structure which is "substantially free of" a bottom would either completely lack a bottom or so nearly completely lack a bottom that the effect would be effectively the same as if it completely lacked a bottom.

As used herein, the term "about" is used to provide flexibility to a numerical range endpoint by providing that a given value may be "a little above" or "a little below" the endpoint while still accomplishing the function associated with the range.

As used herein, a plurality of items, structural elements, compositional elements, and/or materials may be presented in a common list for convenience. However, these lists should be construed as though each member of the list is individually identified as a separate and unique member.

Concentrations, amounts, proportions and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually. This same principle applies to ranges reciting only one numerical value as a minimum or a maximum. Furthermore, such an interpretation should apply regardless of the breadth of the range or the characteristics being described.

Turning now to FIG. 1, there is shown a perspective view of a fully-assembled arm support for a supine patient, generally indicated at 1. The arm support assembly 1 includes two arm rests 5, an anchor or stability plate 100, as well as a pad spacer 25.

The arm rests 5 may include an arm engagement portion indicated generally at 7 which may include an rounded outer support, flange or curve 9, which extends upwardly from a saddle or ergonomic groove 17 in which the arm rests. The rounded outer support, flange or curve 9 prevents the forearm from moving away from the center of the arm support assembly 1. The arm rests may further include an inner support, flange or curve 13, which extends upwardly from the saddle or ergonomic groove 17 and thereby prevents a patient's forearms from sliding inwards, and seats a patient's forearm more directly in the center of the saddle or ergonomic groove 17. (As used herein the term flange does not suggest that the outwardly extending structure is flat. Rather, the flanges may be curved so as to form a saddle shape therebetween).

The arm engagement portion 7 may be held in a desired position to receive the patient's arms by a support frame 15 which is open on the sides. As will be discussed in additional detail below, the open support frame 15 provides improved access to the patient's head if needed.

Before use, the arm support assembly 1 can be slid onto the end of a standard medical table mat or pad. While the arm support assembly 1 can be anchored by multiple mechanisms such as hook and loop fasteners, snaps or screws (not pictured), it may also be held in place by lifting up the edge of the mat and sliding the stability plate 100 between the mat and the table, so that the mat extends into a mat slot, generally indicated at 29, between bases 34 of the support frame 15 and the stability plate 100. Thus, the end of the mat (not pictured) may contact the mat or pad spacer 25. The pad spacer 25 may be sized to fit a standard pad thickness; typically about 2.5 inches, or may be slightly shorter in order to compress the pad and frictionally hold the arm support assembly 1 in place.

The arm support assembly 1 can thus be firmly but removeably attached to a medical mat (not pictured), with the stability plate 100 lying between the mat and the table, while the arm rests 5 extend above the mat.

The pad spacer 25 may be constructed to extend from the support plate 100 at a 90-degree angle, as shown, or may in some embodiments be angled between about 2-15 degrees so that the attached arm rest base 34 slopes downwardly toward the stability plate 100. In such embodiments, the mat slot 29 pinches the mat or pad (not pictured) and prevents the arm support assembly 1 from being inadvertently removed from the medical mat or pad.

To use the arm support assembly 1, a patient may lay down with his or her head positioned between the arm rests 5, with shoulders abutting the shoulder stop or bicep abutment 21. When a patient's arms are raised at approximately a 90-degree angle from the patient's body, with forearms generally parallel to the body, the forearms align with and can be easily slid into the ergonomic grooves 17 formed by the arm rest inner curve 13 and outer curve 9. The inner curve 13 and the outer curve 9 prevent the arms from moving inwardly or outwardly beyond a preferred range of motion, thereby keeping them out of the way and contributing to patient comfort.

Because some medical scanning devices magnetize certain metals, the arm support assembly 1 is preferably made of plastic(s) or other inert material. Those skilled in the art will appreciate a variety of materials which may be used.

As described in more detail below, the anchor or stability plate 100 also may include spacing indicator protrusions 104, which engage with arm rest spacing slots 38. The arm rests 5 may be moved toward or away from each other so as to accommodate people having different shoulder widths, thereby ensuring the patient's arms will properly align with the arms rests without causing unnecessary rotation of the shoulders inwardly or outwardly.

Figure 2:
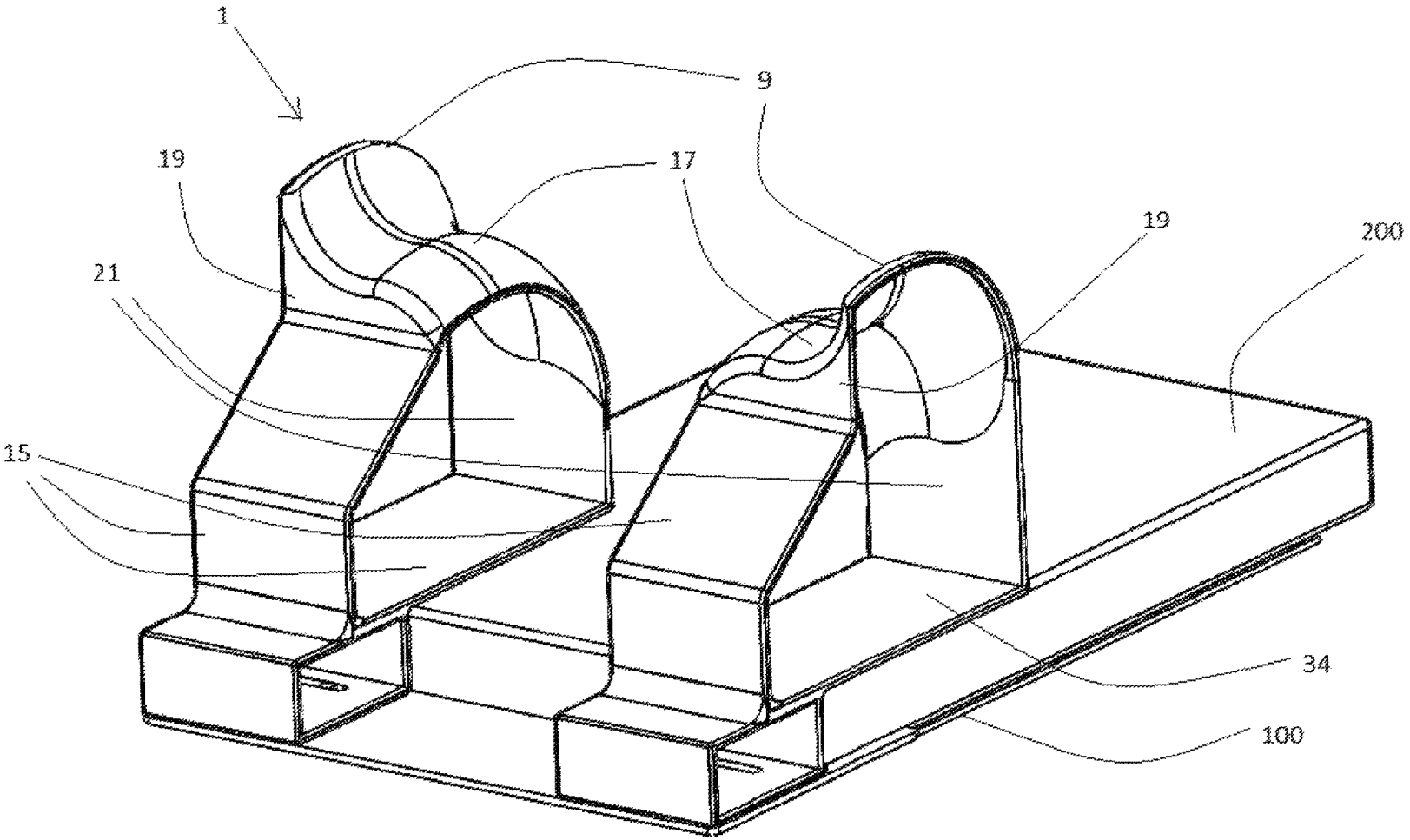
FIG. 2 illustrates a perspective view of another embodiment of an arm support assembly.

FIG. 2 shows a perspective view of an arm support assembly indicated generally at 1 removeably attached to a medical mat or pad 200. For convenience, the medical mat or pad 200 is pictured as being very short and narrow, but it will be appreciated that a mat 200 of any length or width dimensions could be used; typically the medical mat or pad 200 is long enough to cushion a human body.

In the present view, the medical mat 200 is held between the anchor, tongue or stability plate 100 and the arm rest bases 34. Because of this low-profile design, the patient's head may rest directly on the mat 200 or on a small pillow (not shown). In this position, the top and sides of the patient's head can be freely accessed either between the arm rests 5 or through the open support frame 15. This is advantageous if, for example, the patient wishes to be supplied with earplugs or headphones, or if the patient requires supplemental oxygen but the tubes must be kept out of the way.

In the pictured embodiment, the stability plate 100 is positioned between the medical mat 200 and the table (not pictured) on which the medical mat 200 rests. When the patient lays on the mat or pad 200, the patient's weight assists in keeping the stability plate 100 in place, and thus prevents the arm support assembly 1 from sliding free. Other anchors, such as snaps or hook and loop fastener could also be used. When the weight is removed, the arm support assembly 1 can be easily slipped off the medical pad 200.

In some embodiments, the arm support assembly 1 may lack a pronounced rounded inner flange (FIG. 1), while still providing an ergonomic groove 17 for the forearms due to the curvature of the arm rest outer curve or ridge 9.

In the pictured embodiment, the arm support assembly 1 may further include a finger rest or gripping surface 19, as patients may feel more secure if they have a handhold. The finger rest or gripping surface 19 may be, for example, a textured vertical surface as pictured, or may be an integrated handle or strap, or other means known to one of skill in the art for providing a patient with a gripping surface.

One advantage of the present embodiment is that the biceps or upper arms are extended from the patient's body at roughly only a 90-degree angle or less, while the forearms and hands are approximately parallel to the patient's body. This has the benefit of reducing rotator cuff and shoulder strain both along the long axis of the patient and laterally outwardly, while keeping the arms away from the area being scanned. In contrast, some presently available arm rests either require the patient to extend their arms above their head (an uncomfortable position for those with limited axial rotation) or require the arms to rest with the elbows pointed outwardly (an uncomfortable position for those with limited lateral rotation). Because of the close fit of the forearms into the ergonomic groove 17, the elbows cannot fall outwardly, where they may interfere with scanning equipment or medical personnel. Nor can the elbows be moved above the head.

Figure 3:
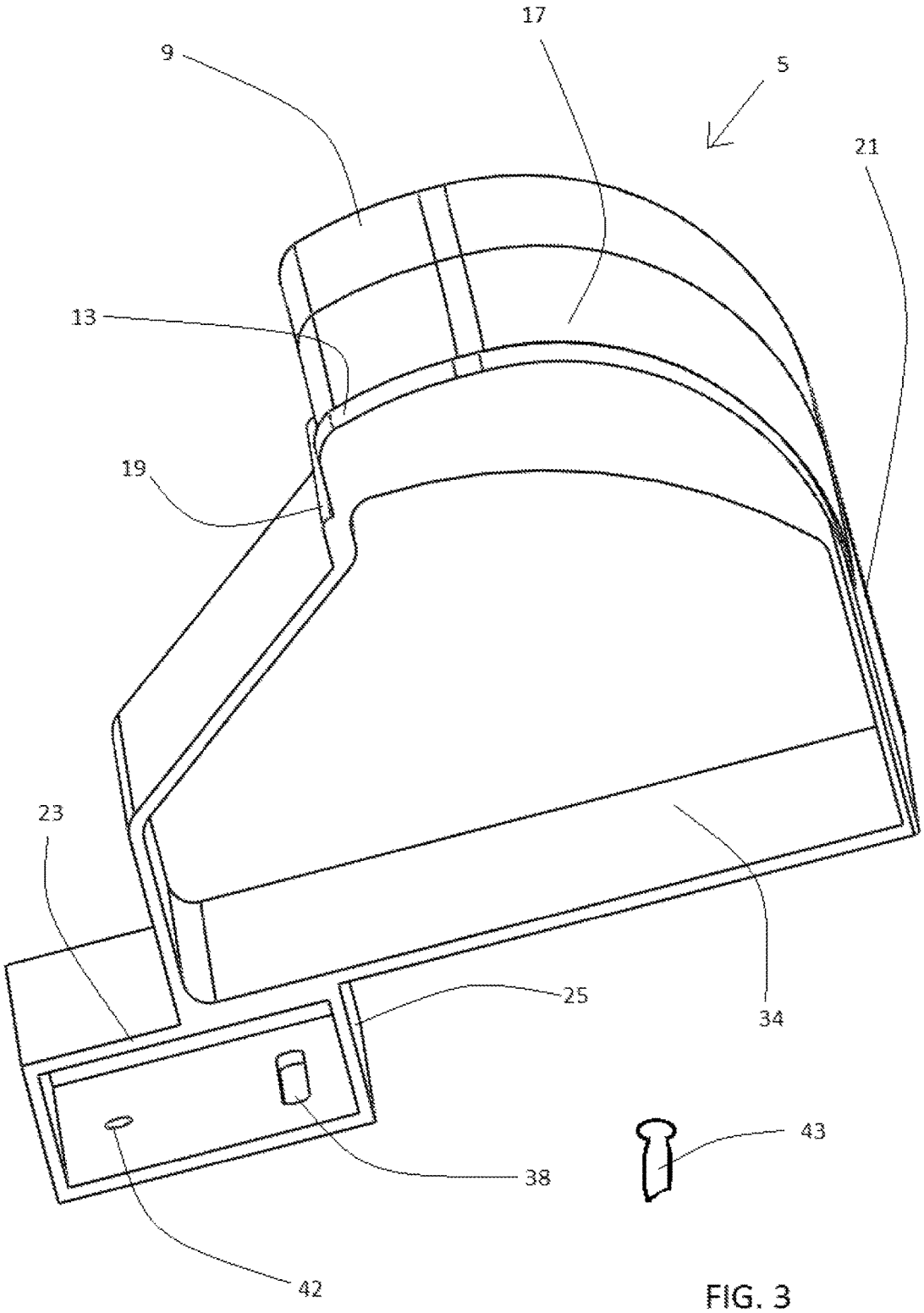
FIG. 3 shows a view from a side perspective of one embodiment of an arm rest.

FIG. 3 is a side perspective view of one embodiment of an arm rest 5, removed from the stability plate (not shown). The present embodiment includes both an arm rest rounded outer flange 9 and a rounded inner flange 13, with an ergonomic groove 17 between. In this perspective, the arm rest spacing cover or slider box 23 can be more clearly viewed.

It is advantageous if the arm rests 5 can be positioned closer together, or farther apart, in order to accommodate varying shoulder widths among patients. This is typically a challenge, as it is inadvisable to use metal slider parts on a device which may be placed inside certain medical scanners, because metal may be magnetized or heated or may interfere with scan results.

Figure 4:
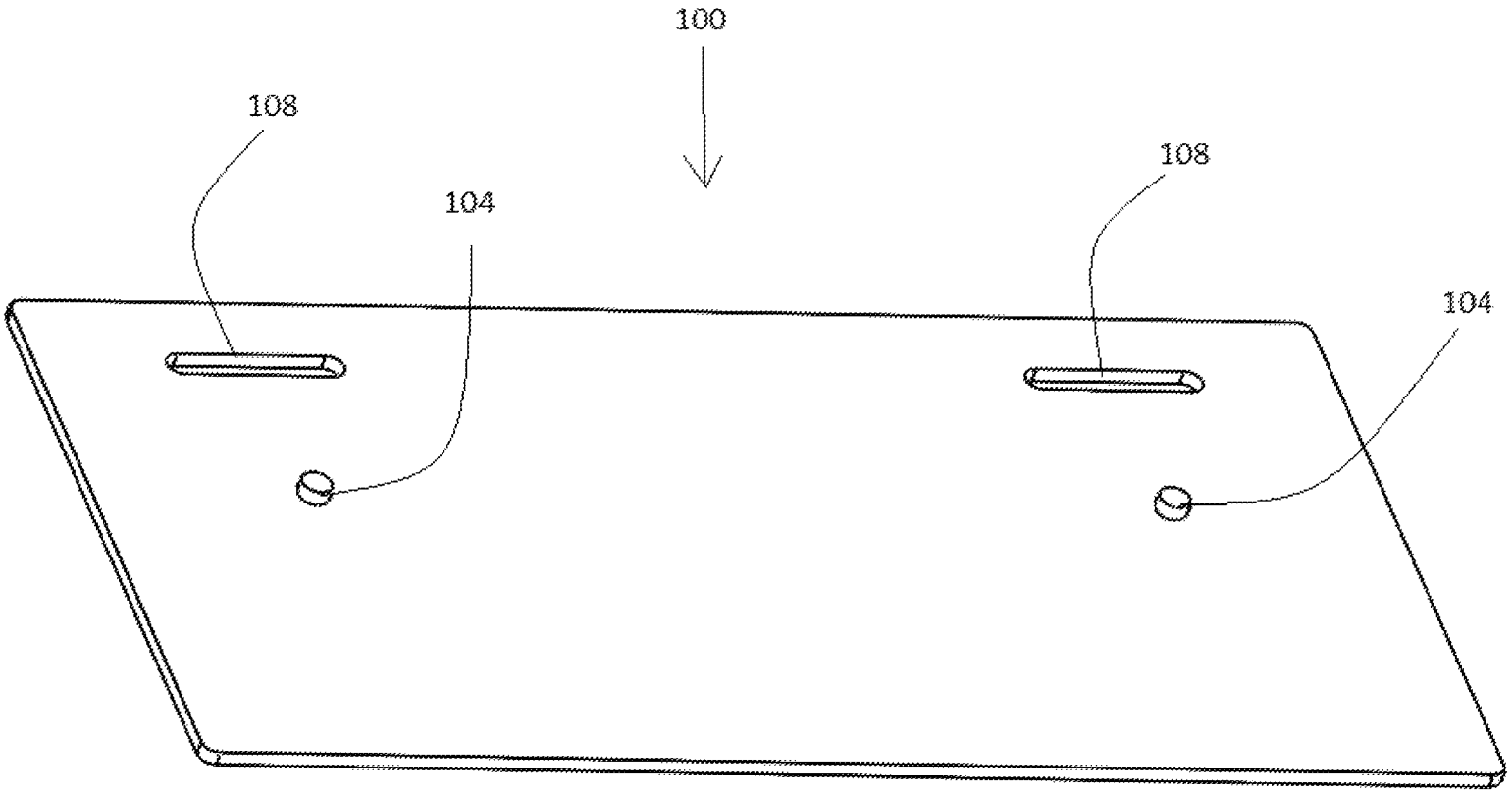
FIG. 4 shows a view of one embodiment of the stability plate.

The slider box 23 of the present embodiment includes a screw opening 42, which may be threaded, and a spacing slot 38. As will be shown in more detail below, the arm rest 5 may be positioned on the stability plate 100, so that the spacing slot 38 aligns with a slide indicator 104 (not shown; see FIG. 4.) Further, the screw opening 42 may be aligned with an anchor slot 108 (not shown; see FIG. 4.) A plastic screw or pin 43 may be inserted into the screw opening 42 and then through the anchor slot 108 (FIG. 4).

In order to adjust the spacing of the arm rest 5, a user removes or loosens the plastic screw or pin 43 from the screw opening 42, and then may slide the arm rest 5 to the desired distance from a plane extending between two arm rests to thereby provide a width between the arm rests to accommodate the size of the patient. The arm rest 5 is prevented from easily sliding too far in either direction, as the slide indicator 104 (FIG. 4) extends up through the spacing slot 38 of the spacer box 23. When the desired position is reached, a user may simply insert the plastic screw or pin 43 into the screw opening 42. In some embodiments, the plastic screw 43 may be formed of a softer or more malleable plastic than the arm rest 5 or stability plate 100 (FIG. 4), so as to ensure a tight fit between the parts. Should the plastic screw or pin 43 become worn or damaged, it may easily be replaced.

One advantage of the pictured embodiment is that the slide indicator or protrusions 104 (FIG. 4) so that if the screw, pin, or dowel 43 loosens during use, the arm rest 5 does not rotate. While the screw 43 can be tightened enough to prevent rotation of the arm rest 5, possible deformation of the plastic screw 43 could result. By providing protrusions 104 fitting into a spacing slot 38, rotation significant enough to hinder comfortable and ergonomic use of the arm support device 1 may be prevented, while still providing for the arm rests 5 to be adjusted to the desired width.

It will be appreciated that other slider mechanisms may be used, such as a pair of screws in the arm rest portion fitting a pair of anchor slots in the stability plate portion. In the present embodiment, however, the arm rest can be loosely snapped into place by fitting the spacing indicator into the arm rest spacing slot, then the arm rest can be slid to the desired width, and then the plastic screw or pin can be inserted into the arm rest screw opening. This process may be quicker and more accurate, as well as allow for easier adjustment, than other methods.

In some embodiments, such as the pictured embodiment, it may be advantageous to fully enclose the slider box or spacer box 23, to avoid any bumping of the plastic screw 43. In other embodiments, a cutout is provided so as to access the plastic screw 43 more easily, and thus more readily adjust the spacing of the arm rests 5.

In some embodiments, more than one screw opening 42 may be present, with a corresponding separate or extended anchor slot 108 (FIG. 4). In some embodiments, in which a particularly tight connection between arm rest 5 and stability plate 100 (FIG. 4) is desirable, the screw opening 42 may be threaded or otherwise textured in order to match the plastic screw or pin 43.

FIG. 3 further shows approximately a 90-degree connection between the pad spacer 25 and the arm rest base 34, however it will be appreciated that the connection may be between about 75-95 degrees. A smaller angle keeps the arm rest base 34 tilted slightly down towards the medical mat (not shown), so that the arm rest 5 pinches the medical mat, helping to hold the arm rest 5 in place.

FIG. 4 shows a perspective view of the stability plate, indicated generally at 100, with an anchor slot 108 and a slide or spacing indicator 104 for each arm rest (FIG. 3). When an arm rest is installed on the stability plate 100, the slide indicator 104 extends up through the spacing slot of the arm rest (FIG. 3), while the plastic screw or pin (FIG. 3) extends down into the anchor slot 108. In order to ensure firm placement of the plastic screw or pin (FIG. 3), the sides of the anchor slot 108 may be textured or ridged.

In some embodiments, the anchor, tongue or stability plate 100 may include more than one anchor slot 108 and/or slide indicator 104 on each side, in order to more firmly attach the arm rests (FIG. 3) to the stability plate 100 with screws, pins or the like. Moreover, the slider box 23 may include extensions which also extend under to mat to further secure the arm rest 5 under the mat, or which may engage the anchor, tongue or stability plate to prevent the arm rest from being pulled away therefrom.

It will be appreciated that the present embodiment allows the arm rests (FIG. 3) to be disassembled from the stability plate 100, making the entire device easy to store and to clean. In addition, should one part show signs of wear, the entire arm support assembly (FIG. 1) need not be replaced; rather, individual parts may be installed as needed, reducing waste.

Figure 5:
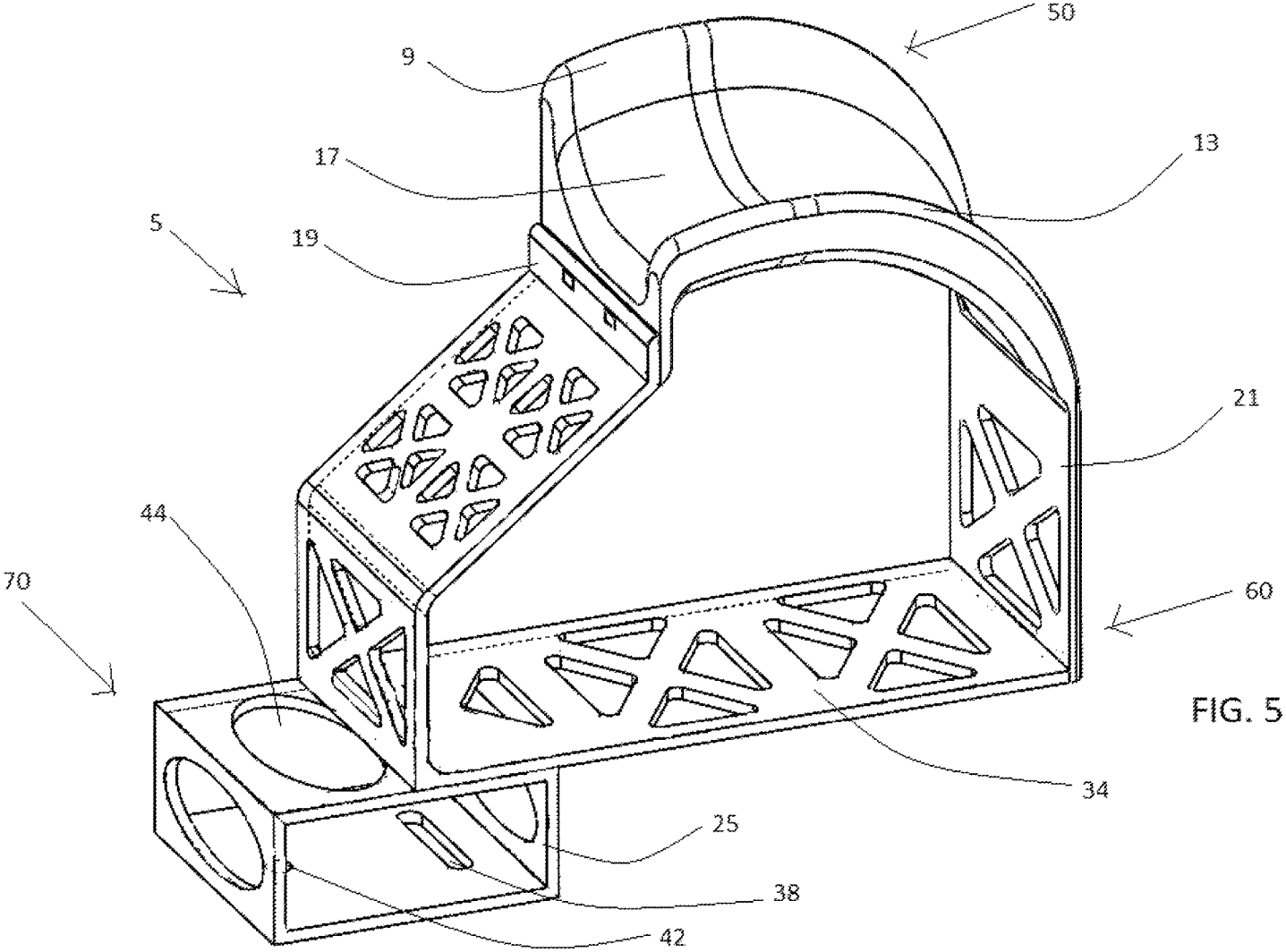
FIG. 5 illustrates a view of one embodiment of a multipart arm rest.

It will be appreciated that for ease of manufacturing or storage, it may be advantageous if the arm rests 5 can be formed in several pieces and then snapped together for use. Turning now to FIG. 5, there is shown an arm rest, indicated generally at 5, which can be formed, shipped, and stored in several parts. The parts may be snapped or slotted together. Thus, as shown in the following drawings, the arm engagement portion 7 of arm rest 5, is formed by an upper portion indicated generally at 50, a support structure indicated generally at 60, and a separate spacer box 70. (While the spacer box may be formed similar to spacer or slider box 23 discussed above, it may also have additional features shown in spacer box 70 below). The three parts together form the arm rest 5.

Also shown is an access cutout 44 for accessing the arm rest screw opening 42, into which can be inserted a plastic screw or pin (not shown.)

Figure 6:
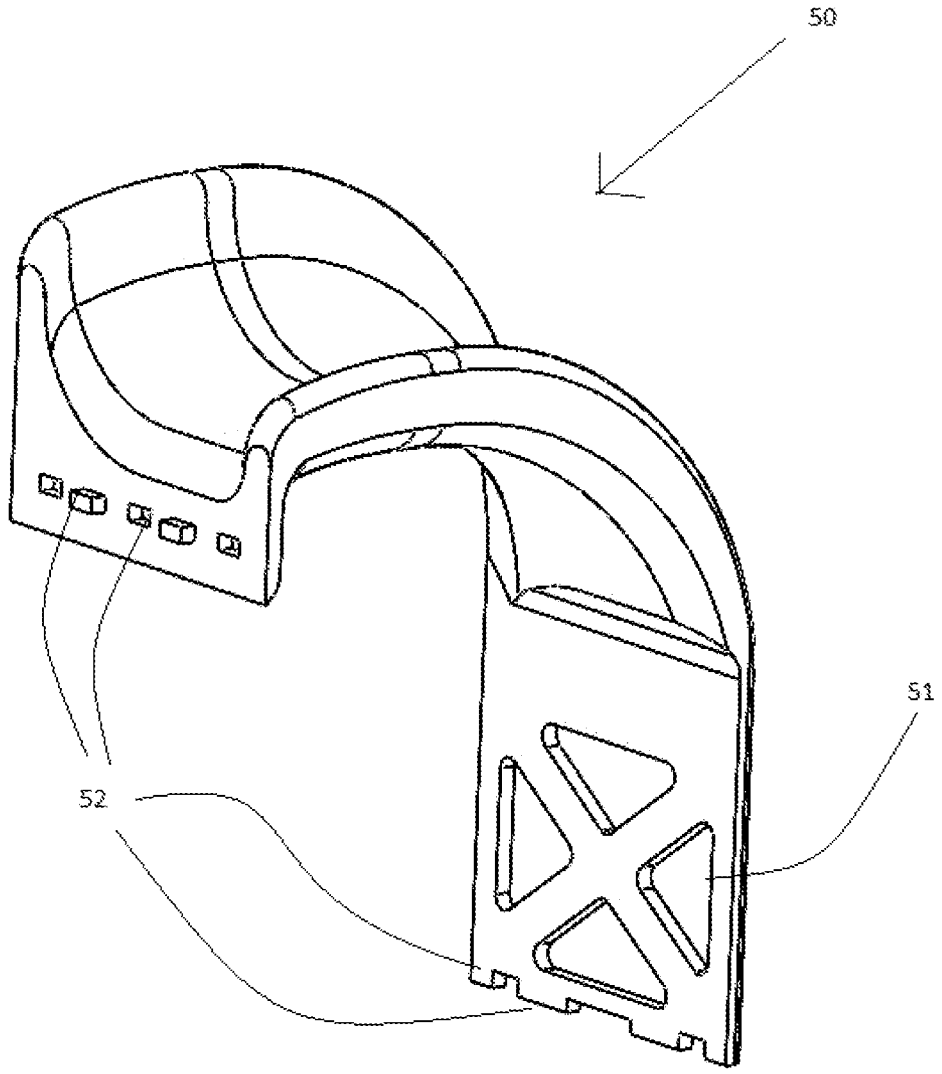
FIG. 6 shows one embodiment of a snap-together part of an arm rest.
Figure 7:
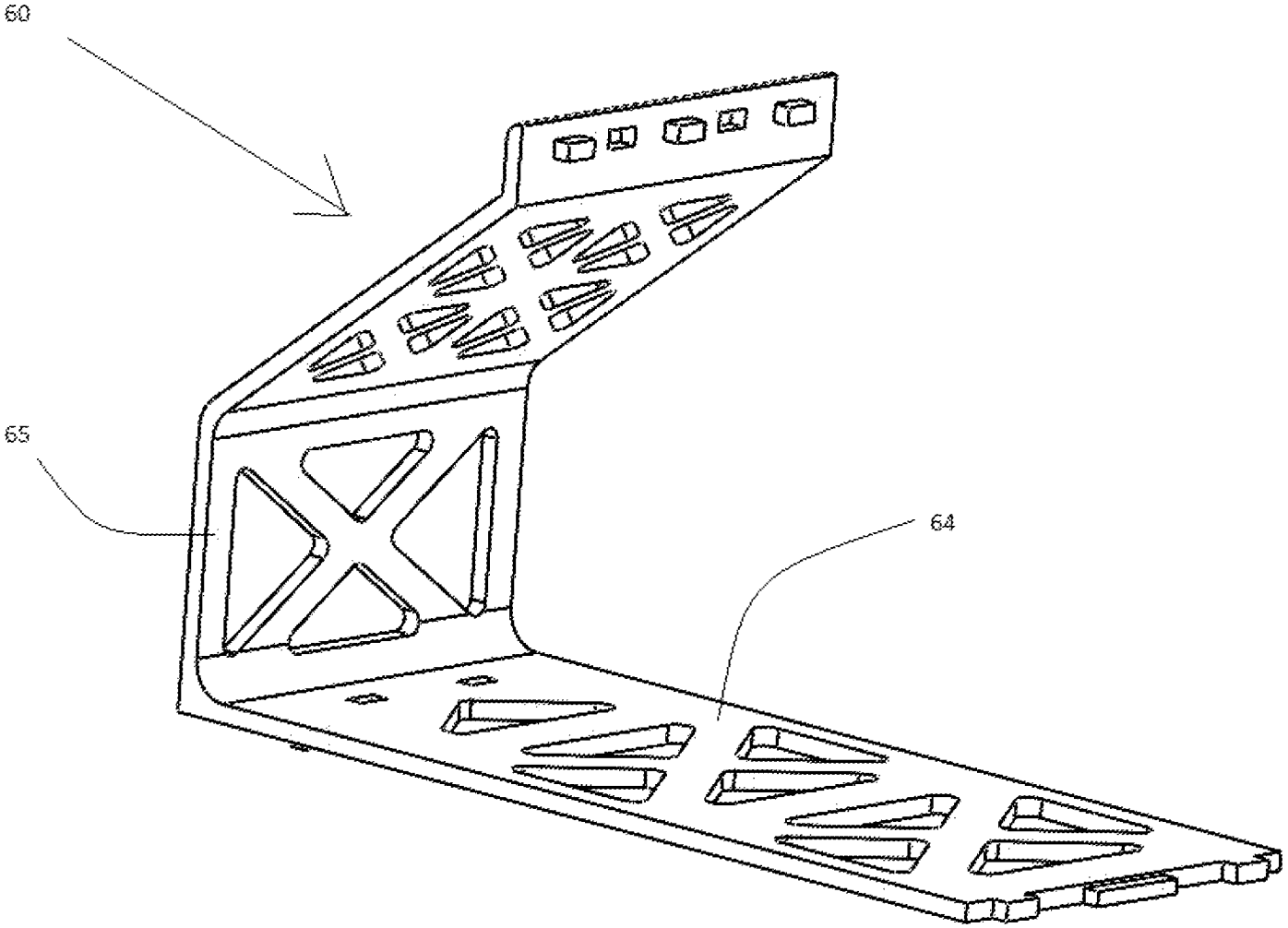
FIG. 7 illustrates one embodiment of a snap-together part of an arm rest.
Figure 8:
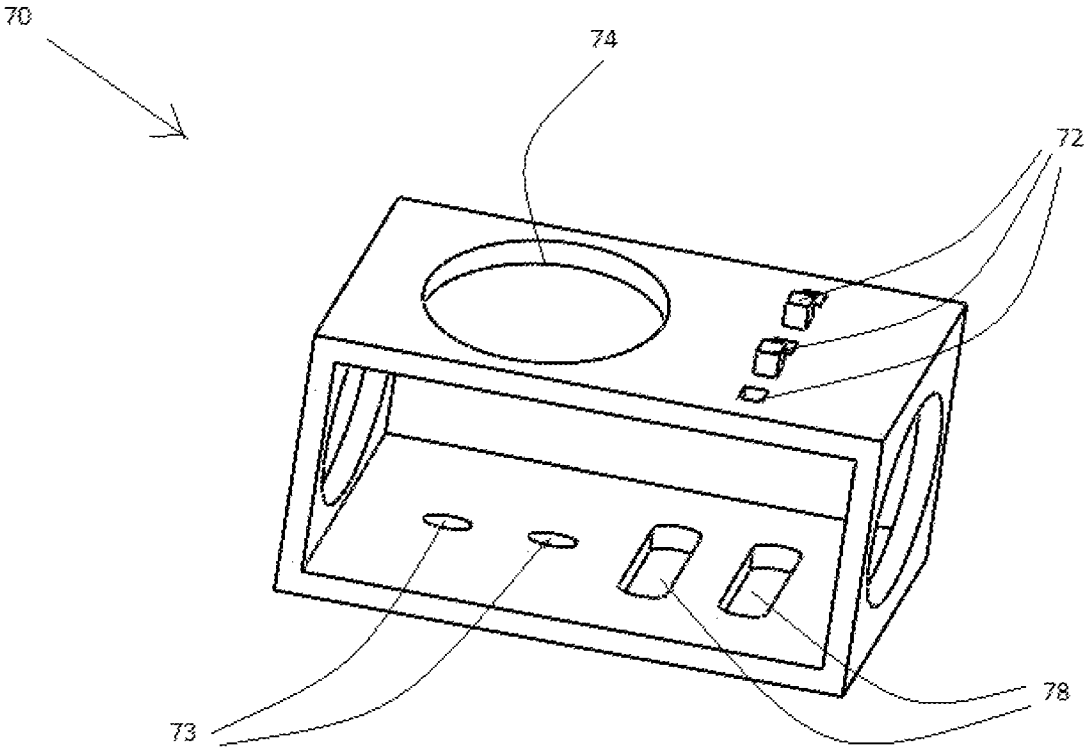
FIG. 8 shows a view of one embodiment of a snap-together part of an arm rest.

FIGS. 6, 7, and 8 are perspective views of three portions or parts of an arm rest which may be produced as separate pieces and snapped together when in use, reducing storage, shipping, and manufacturing costs.

FIG. 6 shows one embodiment of the snap-together upper portion of an arm rest, indicated generally at 50. Cutouts 51 may be included to reduce weight and material costs, while a series of notches and protrusions 52 enable the pieces of the arm rest 5 to be snapped together. The notches and protrusions 52 may be sized differently, so that the parts will only snap together when joined in the correct orientation. It will be appreciated that other means of joining separate pieces are possible, such as a grooved notch into which a protrusion on another piece can be slid.

FIG. 7 illustrates one embodiment of a snap-together support structure part of an arm rest, generally indicated at 60, including the modified arm rest base 64 and the modified pad or mat spacer 65.

FIG. 8 shows a view of one embodiment of a snap-together spacer box part of an arm rest, including the modified spacer box 70, notches and protrusions 72 which may be used to snap together another part of the arm rest, and an access cutout 74 for accessing the arm rest screw opening 73. In the present embodiment, a pair of arm rest screw openings 73, and arm rest spacing slots 78, are provided. These may, for example, match with an equivalent pair of spacing indicators (FIG. 4) and anchor slots (FIG. 4) in the stability plate (FIG. 4), allowing for a tighter connection between the arm rest and stability plate (FIG. 4). Alternately, they may be used with a standard stability plate.

Figure 9:
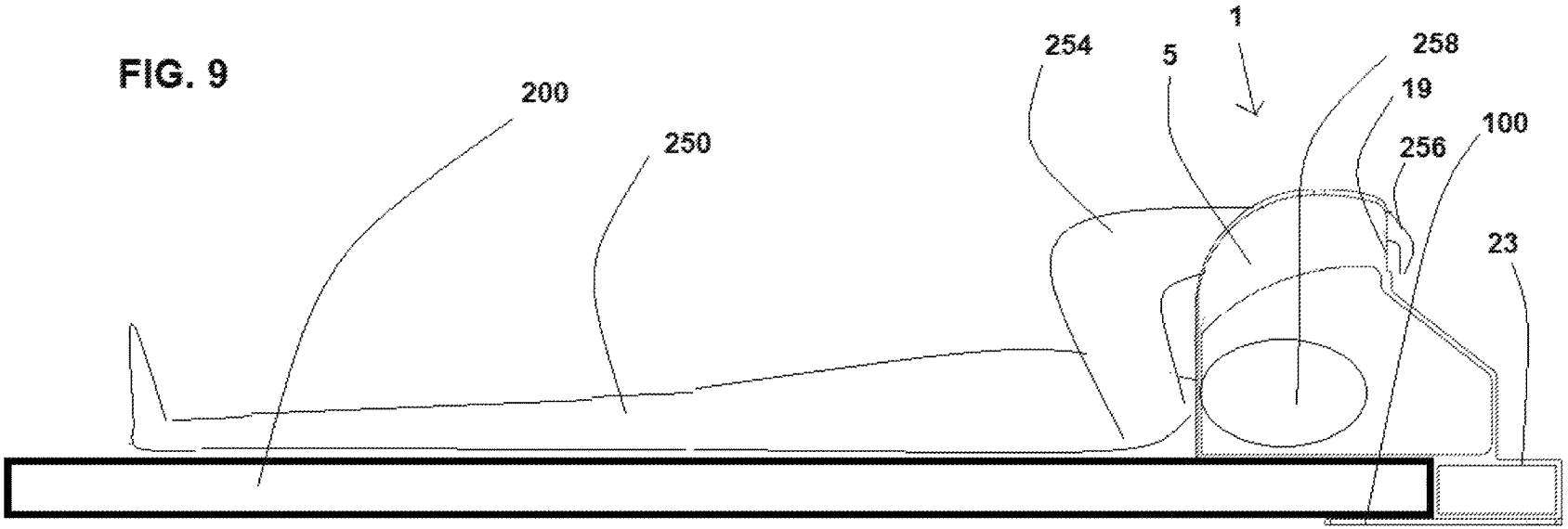
FIG. 9 shows a view from the side of a patient using the arm rest.

Turning now to FIG. 9, there is shown a silhouette of a patient 250 using the arm support assembly 1. The patient 250 is lying on the mat 200 of a medical imaging table. The stability plate 100 is nested under the end of the mat 200, and the arm rest 5 extends above the mat. The patient's arms 254 extend generally perpendicularly from the patient along the upper arm, while the forearm rests on the arm rest 5. The hand 256 can grip the finger rest 19. Openings in the arm rests 5 provide access to the patient's head 258 if needed. This is a comfortable position, as the patient's arms are not extended too far axially over the head and are not rotated outwardly away from the body.

Thus there is disclosed an arm support for a supine patient and methods of making and using the same. It will be appreciated that numerous modifications may be made without departing from the scope and spirit of this disclosure. The appended claims are intended to cover such modifications.

What is claimed is:

1. An arm support assembly comprising:

a stability plate; and a slideable arm rest releaseably attached to the stability plate, the slideable arm rest having an ergonomic groove, wherein the arm support assembly further comprises:

an upper portion having a first set of notches and protrusions the first set of notches and protrusions being adapted to snap the upper portion and a base portion together;

the base portion having a second set of notches and protrusions being adapted to snap the upper portion and the base portion together; and a spacer box portion having a third set of notches and protrusions, the third set of notches and protrusions being adapted to snap the base portion and the spacer box portion together.

2. The arm support assembly of claim 1, wherein the slideable arm rest further comprises a pad spacer adapted to fit a medical pad.

3. The arm support assembly of claim 2, wherein the slideable arm rest further comprises a shoulder stop disposed at a right angle to the stability plate.

4. The arm support assembly of claim 3, wherein the slideable arm rest further comprises an arm rest inner curve and an arm rest outer curve.

5. The arm support assembly of claim 4, wherein the slideable arm rest further comprises a gripping surface.

6. The arm support assembly of claim 4, wherein the slideable arm rest further comprises head-access openings.

7. The arm support assembly of claim 3, wherein the slideable arm rest further comprises an arm rest spacing slot and an arm rest screw opening.

8. The arm support assembly of claim 7, wherein the stability plate further comprises a spacing indicator and an anchor slot.

9. The arm support assembly of claim 8, wherein the slideable arm rest comprises a second arm rest screw opening, and wherein the stability plate comprises a second anchor slot.

10. The arm support assembly of claim 8, wherein the slideable arm rest comprises a second arm rest spacing slot, and wherein the stability plate comprises a second spacing indicator.

11. The arm support assembly of claim 8, wherein the slideable arm rest further comprises a screw access cutout.

12. The arm support assembly of claim 2, wherein the slideable arm rest further comprises an arm rest base, and wherein the pad spacer is connected to the arm rest base at a pad spacer angle, the pad spacer angle being less than ninety degrees.

13. The arm support assembly of claim 2, wherein the slideable arm rest is made of plastic.

14. The arm support assembly of claim 11, wherein the stability plate is made of plastic.

15. The arm support assembly of claim 1, further comprising a second slideable arm rest releaseably attached to the stability plate.

16. The arm support assembly of claim 1, further comprising a screw access cutout in the spacer box portion.

17. A kit comprising:

a stability plate having a spacing indicator and an anchor slot;

an arm rest upper portion having an inner curve, an outer curve, and a first set of notches and protrusions;

an arm rest base portion a shoulder stop, and a second set of notches and protrusions; and a spacer box portion having a pad spacer, a third set of notches and protrusions, an access cutout, an arm rest spacing slot, and an arm rest screw opening;

the first set of notches and the protrusions being adapted to snap the arm rest upper portion to at least the arm rest base portion, the second set of notches and protrusions being adapted to snap the arm rest base portion to at least the arm rest upper portion, and the third set of notches and protrusions being adapted to snap the arm rest spacer box portion to at least the arm rest base portion.

18. An arm support assembly comprising:

a stability plate; and a slideable arm rest releaseably attached to the stability plate, the slideable arm rest having an ergonomic groove, wherein the arm support assembly further comprises:

an upper portion having a first set of grooves and protrusions the first set of grooves and protrusions being adapted to snap the upper portion and a base portion together;

the base portion having a second set of grooves and protrusions being adapted to snap the upper portion and the base portion together; and a spacer box portion having a third set of grooves and protrusions, the third set of notches and protrusions being adapted to snap the base portion and the spacer box portion together.

19. The arm support assembly of claim 18, wherein the slideable arm rest further comprises head-access openings.

* * * * *